US005945644A

United States Patent [19]

Jang

[11] Patent Number: 5,945,644

[45] Date of Patent: Aug. 31, 1999

[54] APPARATUS AND METHOD FOR CONTROLLING EMERGENCY OPERATION IN ELEVATOR SYSTEM

[75] Inventor: Cheol-Ho Jang, Changwon, Rep. of Korea

[73] Assignee: LG Industrial Systems Co., Ltd., Seoul, Rep. of Korea

[21] Appl. No.: 08/962,679

[22] Filed: Nov. 3, 1997

[30] Foreign Application Priority Data

Nov. 4, 1996 [KR] Rep. of Korea ..... 96-51758

[51] Int. Cl.[6] ..... B66B 1/28

[52] U.S. Cl. ..... 187/296; 187/293; 187/393

[58] Field of Search ..... 187/296, 293, 187/290, 391, 393

[56] References Cited

U.S. PATENT DOCUMENTS 4,483,419 11/1984 Salihi et al. ..... 187/29 R
5,285,029 2/1994 Araki ..... 187/290
5,698,823 12/1997 Tanahashi ..... 187/296
5,796,228 8/1998 Kojima et al. ..... 318/605

FOREIGN PATENT DOCUMENTS 54-140916 11/1979 Japan ..... 187/296

*Primary Examiner*—Robert E. Nappi

[57] ABSTRACT

An apparatus and method for controlling an emergency operation in an elevator system. The apparatus includes an inverter for inverting a direct voltage into alternating voltages and driving an induction motor with the alternating voltages, a current detector for detecting a current that flows through a first coil of the induction motor, a speed detector for detecting a speed of the induction motor and outputting phase signals, and a control circuit for receiving the current outputted from the current detector and the phase signals outputted from the speed detector and outputting a voltage command to the inverter. The apparatus and method shorten a rescue time by determining an elevator car driving direction by the use of the phase signals outputted form the speed detector during a driving interruption caused by an abnormal or emergency situation.

15 Claims, 7 Drawing Sheets

ωr

FIG. 7A
FIG. 7B
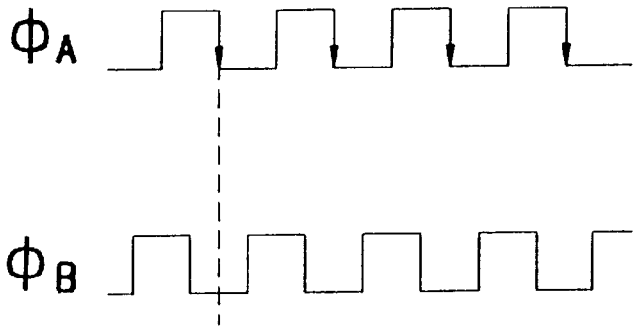
FIG. 8A
FIG. 8B
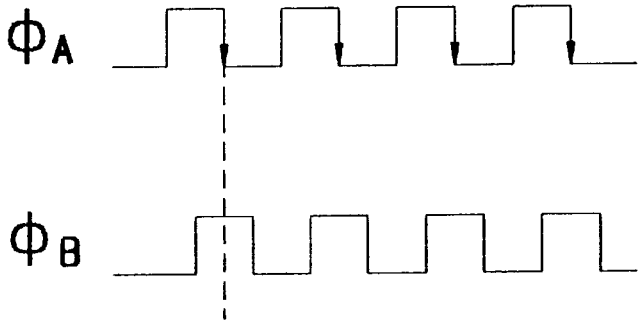

APPARATUS AND METHOD FOR CONTROLLING EMERGENCY OPERATION IN ELEVATOR SYSTEM

BACKGROUND OF THE INVENTION

1. Field of the Invention

The present invention relates to an emergency operation for an elevator system, and more particularly to an improved apparatus and method for controlling an emergency operation of an elevator system during a power failure in the elevator system, which is capable of easily determining respective driving directions of elevator cars.

2. Description of the Background Art

In a general elevator system, there may be provided an auxiliary system to guide an elevator car to the nearest floor for a safe rescue of passengers aboard the car in case of an electrical power failure during its operation. Such an auxiliary system is referred to as ALP (Automatic Landing for Power failure).

When there is a power failure in the system, the ALP powered by a battery serves to convert a direct current voltage of the battery into an alternating current voltage, which is in turn supplied to the elevator system, thereby enabling the passengers aboard the elevator car to be safely rescued.

As shown in FIG. 1 illustrating a conventional emergency control apparatus of an elevator system, the control apparatus includes a source 1 of main (utility) power; a switching node 2 that is connected only during the normal supplying of power from the power source 1; a converter 3 converting the alternating current voltage that has passed through the switching node 2 into a direct current voltage, and supplying the direct current voltage to an inverter 7; the inverter 7 converting the received direct current voltage into alternating current voltages with three phases and three phase frequencies; an induction motor 9 driven by the alternating current voltages with three phases and three phase frequencies; a pulley 12 engaged to a shaft driven by the induction motor 9; a brake 11 for controlling a car operation; a balance weight 17 which weighs an amount obtained by adding the car weight and one-half of a reference load on the car; a load detector 16 detecting the load in a cage 15; a speed detector 10 for detecting an angular velocity of the induction motor 9; a current detector 8 detecting the current that flows through a first coil of the induction motor 9; a control circuit 14 receiving respective output signals from the current detector 8, the speed detector 10 and the load detector 16, transmitting a control signal to a semiconductor device 6 that allows the current to flow through a resistor resistance 5 for thereby consuming a regenerative power, and outputting a voltage command to the inverter 7 that controls the induction motor 9; a transformer 13 providing a supply voltage to the control circuit 14; and an emergency power supply unit 19 providing the supply voltage from the battery 20 to the elevator system through a switching node 18.

FIG. 2 is a block diagram detailing the conventional emergency control apparatus of FIG. 1 during a power failure. As shown therein, the control apparatus includes; the control circuit 14; the load detector 16 supplying a load weight signal $W_L$ to the control circuit 14; the current detector 8 supplying a current signal I to the control circuit 14; the speed detector 10 supplying phase signals $\phi_A$, $\phi_B$ to the control circuit 14; the inverter 7 receiving a voltage command signal V* outputted from the control circuit 14; and the induction motor 9 being controlled by an output signal from the inverter 7.

The control circuit 14 includes a load detection unit 27 receiving the load weight signal $W_L$ of the cage 15, which is detected by the load detector 16; a speed detection unit 28 for receiving the phase signals $\phi_A$, $\phi_B$ from the speed detector 10 and calculating therefrom an angular velocity signal $\omega_r$ of the induction motor 9; a driving direction setting unit 21 receiving an output signal from the load detection unit 27 and the angular velocity $\omega_r$ from the speed detection unit 28, and determining a car driving direction; a speed command generator 22 receiving an output signal from the driving direction setting unit 21 and outputting a speed command $\omega_r$*; a first subtractor 23 outputting a difference signal between the speed command $\omega_r$* and the angular velocity $\omega_r$; a speed controller 24 amplifying the difference signal outputted from the first subtractor 23 and outputting a current command I*; a second subtractor 25 outputting a difference between the current command I* and the current I; and a current controller 26 amplifying the difference outputted from the second subtractor 25 and outputting a voltage command V*.

FIG. 3 is a schematic view illustrating the load detector 16. As shown therein, the load detector 16 is accompanied by a pair of vibration-absorbing rubbers 30 provided between the bottom of the cage 15 and an elevator car casing 29.

FIG. 4A is a graph illustrating the relation between node state and load weight, and FIG. 4B is a graph illustrating the relation between voltage and load weight.

The operation during a power failure of the above-described conventional emergency control apparatus of FIG. 1 for an elevator system will now be explained.

When the supply voltage from the power source 1 is normally provided, the switching node 2 is connected, and the switching node 18 is disconnected. The supply voltage is provided to the converter 3 serving to supply the direct current voltage to the inverter 7, and to the transformer 13 providing the source voltage to the control circuit 14.

Here, when the control circuit 14, which has received respective output signals from the speed detector 10, the current detector 8 and the load detector 16, applies the voltage command V* to the inverter 7, the inverter 7 provides the alternating current voltages with three phases and three phase frequencies to the induction motor 9, whereby the control circuit 14 serves to control the torque and rotation of the induction motor 9.

In the case in which there occurs a regenerated voltage from the induction motor 9 and the regenerated voltage is detected by the current detector 8, the control circuit 14 turns on the semiconductor device 6, for consuming the regenerated voltage in the resistor 6.

When there occurs an emergency situation such as a power failure, the switching node 18 is connected, whereas the switching node 2 is disconnected. At this time, the emergency power supply 19 converts the direct current voltage outputted from the battery 20 into the three-phase alternating current voltage and the converted voltage is provided to the converter 3 and the transformer 13.

The control circuit 14 being operated by the voltage source provided from the transformer 13 controls the inverter 7 in the same way as when the supply voltage outputted from the power source 1 is provided.

Specifically, as shown in FIG. 5, when the power fails (Step S1), the load detection unit 27 receives the cage load detected (Step S2) by the load detector 16 and judges (Step S3) whether the load weight $W_L$ is more than 50% of the allowed weight. If the judged value is more than 50% of the allowed weight, the driving direction setting unit 21 allows the speed command generator 22 to output the speed command $\omega_r$* for thereby descending (Step S4) the elevator car; otherwise, the elevator car is ascended (Step S5).

That is, when the speed command $\omega_r$* is applied to the speed controller 24 which serves to output the current command I*, the current controller 26 which has received the current command I* applies the voltage command V* to the inverter 7 which serves to drive the induction motor 9 for thereby carrying out the car driving operation.

Next, an emergency operation time $T_R$ which has been counted since the start of the car operation, and a set time $T_S$ are compared to each other (Step S6), so that when the emergency operation time $T_R$ is more than the set time $T_S$, the angular velocity $\omega_r$ is applied (Step 7) to the driving direction setting unit 21 and the first subtractor 23; otherwise, the descending or ascending operation continues until more than the set time $T_S$ is reached.

The driving direction setting unit 21 compares (Step S8) the applied angular velocity $\omega_r$ with the set velocity $\omega_{st}$, and when the angular velocity $\omega_r$ is more than the set velocity $\omega_{st}$, the elevator car is not set to be driven (Step S9) toward the initial driving direction; otherwise, the driving direction is reversed (Step S10). At this time, the car operation continues until the difference between the angular velocity $\omega_y$ and the angular velocity command in the first subtractor becomes "0" or the difference between the current I and the current command I* becomes "0", for thereby completing (Step 11) the rescuing operation of the elevator system.

However, in the conventional emergency control apparatus, the elevator car driving direction is dependent upon an output signal from the load detector 16 installed between the elevator casing 29 and the cage 15, as shown in FIG. 3, and therefore if the vibration-absorbing rubbers 30 provided adjacent to the load detector 16 are not functional, the emergency driving time becomes disadvantageously longer when the power fails. That is, the vibration-absorbing rubbers 30 are difficult to install and further suffer wears as time lapses, thereby interrupting an accurate detection of the load weight $W_L$ as well as elongating a rescue time due to a possible erroneous operation of the elevator car.

SUMMARY OF THE INVENTION

Accordingly, it is an object of the present invention to provide an apparatus and method for controlling an emergency operation in an elevator system during a power failure, which is capable of shortening a rescue time by determining an elevator car driving direction by the use of phase signals from a speed detector engaged to a shaft of an induction motor during a driving interruption caused by a power failure, for thereby overcoming the conventional disadvantages in which an elevator car driving direction is determined only by a load detector.

To achieve the above-described and other objects, an apparatus for controlling an emergency operation in an elevator system during a power failure according to the present invention includes an inverter for inverting a direct current voltage into an alternating current voltages with three phases and three phase frequencies and driving an induction motor therewith, a current detector for detecting a current I that flows through a first coil of the induction motor, a speed detector for detecting a speed of the induction motor and outputting phase signals $\phi_A$, $\phi_B$, and a control circuit for receiving the current I outputted from the current detector and the phase signals $\phi_A$, $\phi_B$ outputted from the speed detector and outputting a voltage command V* to the inverter.

Further, to achieve the above-described and other objects, a method for controlling an emergency operation during a power failure in an elevator system according to the present invention includes the steps of determining whether an elevator car is at a door zone of the elevator system which is accessible to and from an outside thereof, determining a driving direction of the elevator car in accordance with phase signals from a motor speed detector in a way in which when the elevator car is at the door zone, the elevator door is opened, and otherwise a brake is released, determining whether a count time $T_{BR}$ is equal to or greater than a setting time $T_{BS}$, wherein the count time $T_{BR}$ is counted from a time point in which the brake was released, determining whether an angular velocity $\omega_r$ of the induction motor is equal to or greater than a setting velocity $\omega_{st}$ when the count time is greater than the setting time, and maintaining a current direction determined after releasing the brake when the angular velocity $\omega_r$ is equal to or greater than the setting velocity $\omega_{st}$, and otherwise, changing the driving direction of the elevator car.

BRIEF DESCRIPTION OF THE DRAWINGS

The present invention will become better understood with reference to the accompanying drawings which are given only by way of illustration and thus are not limitative of the present invention, wherein:

FIGS. 7A, 7B, 8A, and 8B are timing diagrams of output signals from a speed detector with regard to a driving direction of an induction motor according to the present invention.

DETAILED DESCRIPTION OF THE PREFERRED EMBODIMENTS

Figure 1:
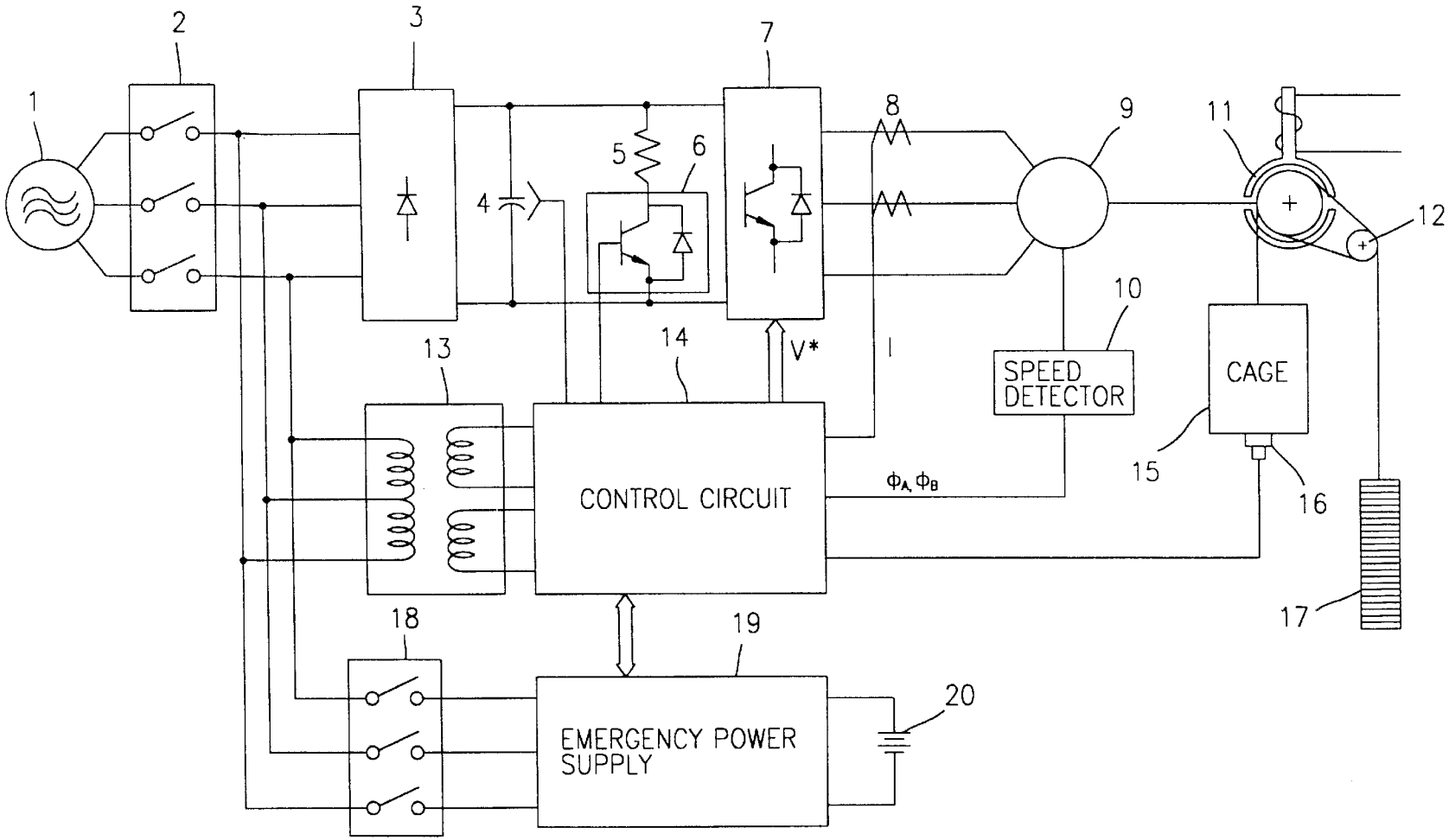
FIG. 1 CONVENTIONAL ART
FIG. 1 is a block diagram illustrating an apparatus for controlling an emergency operation in an elevator system according to the conventional art.
Figure 6:
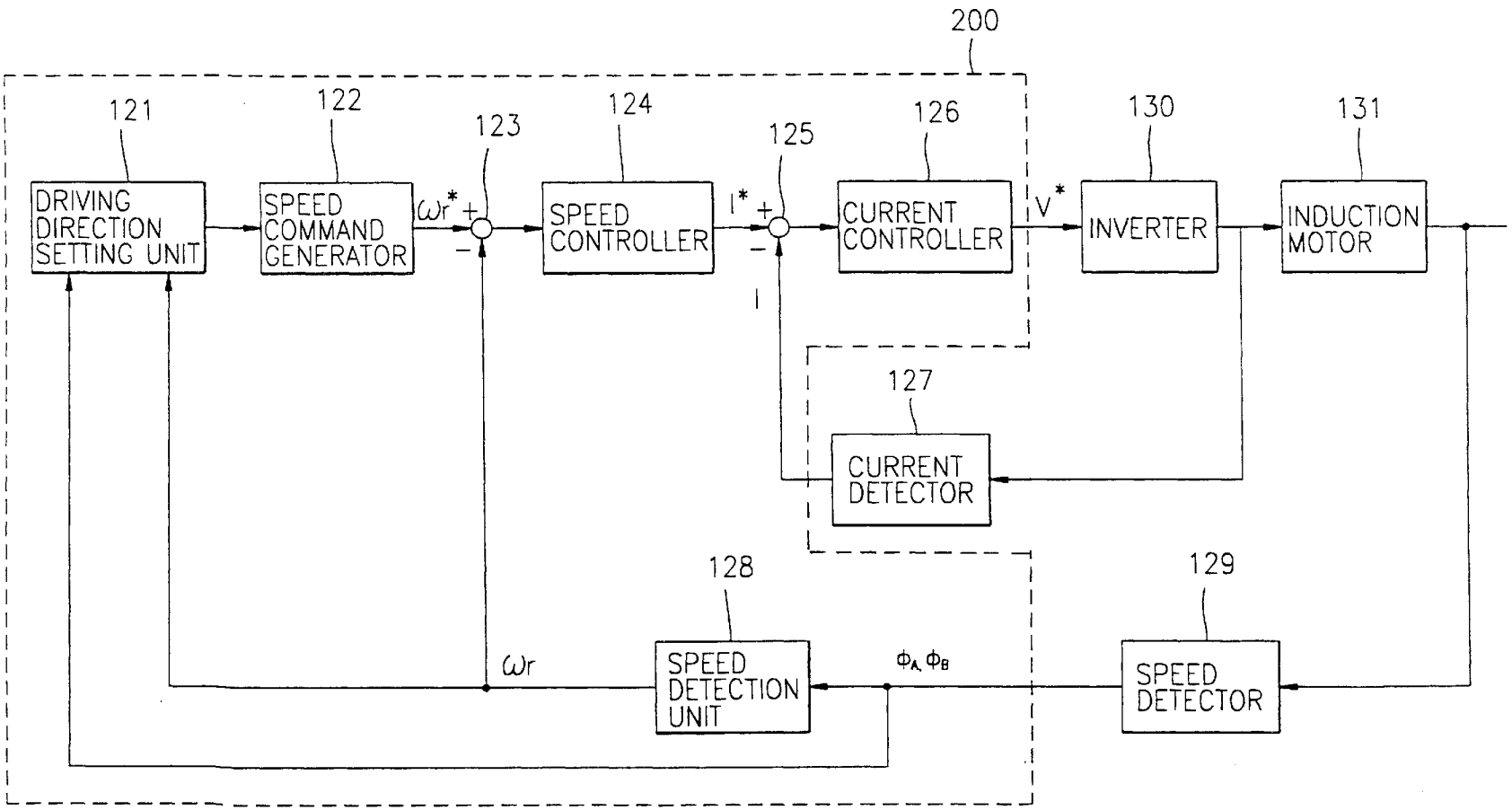
FIG. 6 is a block diagram detailing an emergency control apparatus for an elevator system according to the present invention.

As shown in FIG. 6, the emergency control apparatus for an elevator system according to the present invention includes a control circuit 200; a current detector 127 for applying a current I to the control circuit 200; a speed detector 129 for detecting a velocity value of an induction motor 131 and outputting phase signals $\phi_A$, $\phi_B$ to the control circuit 200; an inverter 130 controlled by the control circuit 200; and the induction motor 131. The elevator system according to the present invention includes the elements shown in FIGS. 1 and 2 with the control circuit 14, the inverter 7, the induction motor 9, the load detector 16, the current detector 8, and the speed detector 10 in FIG. 2 substituted with the corresponding elements shown in FIG. 6.

Figure 2:
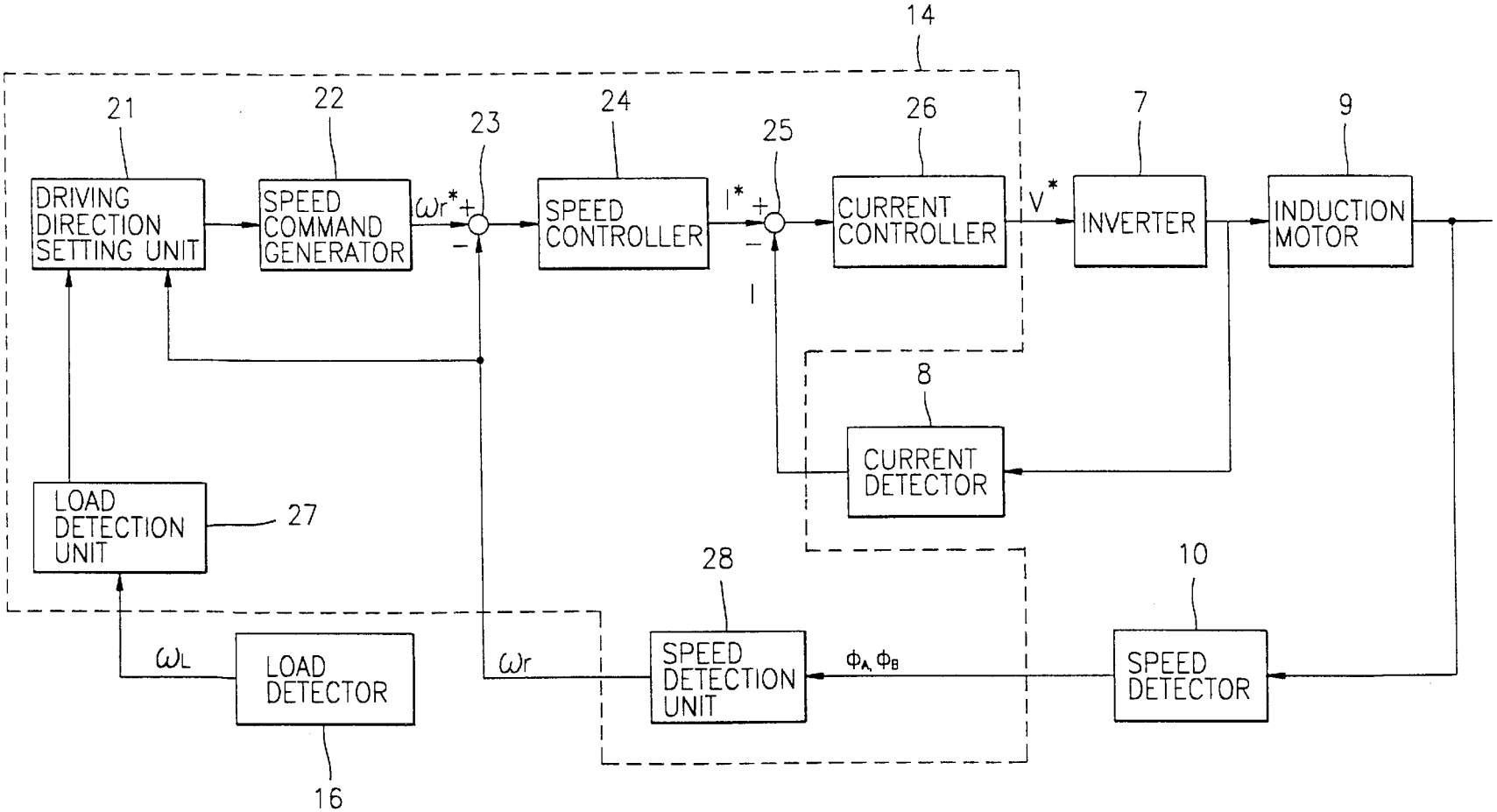
FIG. 2 CONVENTIONAL ART
FIG. 2 is a block diagram detailing an emergency control apparatus in the conventional elevator system of FIG. 1.
Figure 3:
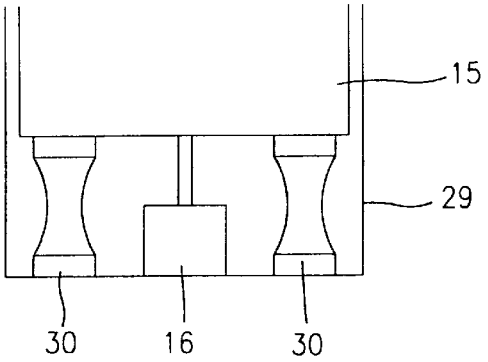
FIG. 3 CONVENTIONAL ART
FIG. 3 is a schematic cross-sectional view illustrating a load detector of the system on FIG. 1 according to the conventional art.
Figure 4A:
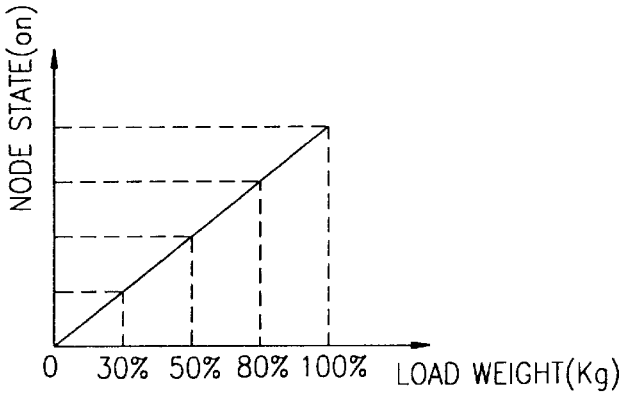
FIG. 4A CONVENTIONAL ART
FIG. 4A is a graph illustrating the relation between node state and load weight with regard to the load detector according to the conventional art.
Figure 4B:
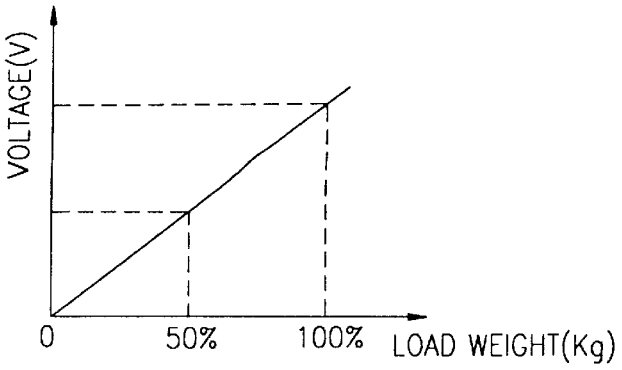
FIG. 4B CONVENTIONAL ART
FIG. 4B is a graph illustrating the relation between voltage and load weight with regard to the load detector according to the conventional art.
Figure 5:
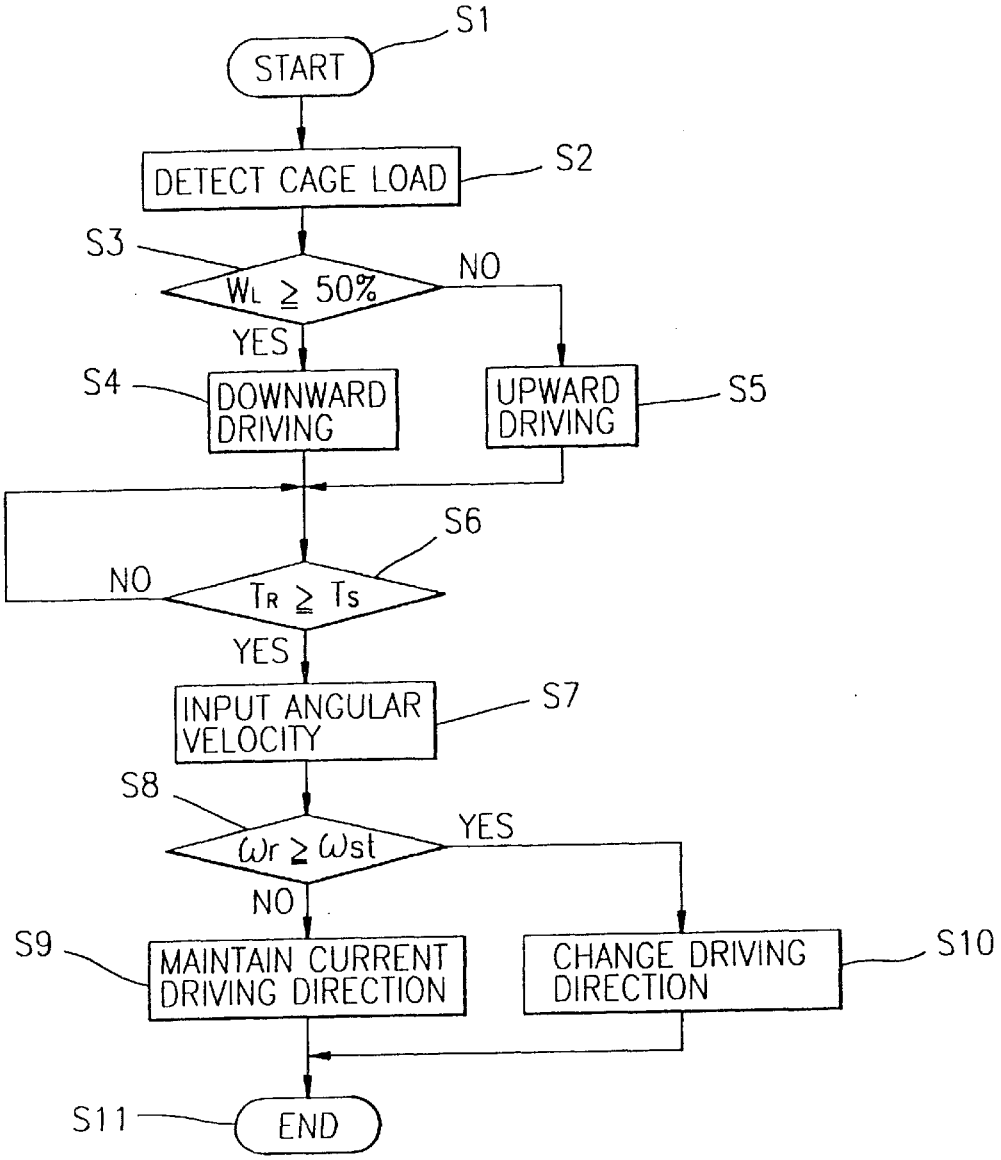
FIG. 5 CONVENTIONAL ART
FIG. 5 is a flow chart illustrating a conventional method for controlling an emergency operation in an elevator system.

The control circuit 200 includes a driving direction setting unit 121 for receiving the phase signals $\phi_A$, $\phi_B$ outputted from the speed detector 129 and an angular velocity signal $\omega_r$ outputted from a speed detection unit 128, and determining a driving direction of the elevator car; a speed command generator 122 for receiving an output signal from the driving direction setting unit 121 and outputting a speed command signal $\omega_r$*; a first subtractor 123 for outputting a difference between the speed command $\omega_r$* and the angular velocity $\omega_r$; a speed controller 124 for amplifying an output signal from the first subtractor 123 and outputting a current command I*; a second subtractor 125 for outputting a difference between the current command I* and the current I outputted from the current detector 127; and a current controller 126 for amplifying the difference signal outputted from the second subtractor 125 and outputting a voltage command V*. Here, it should be understood that the present invention does not employ the load detection unit 27 which is required in the control circuit of the conventional art as shown in FIG. 2.

FIGS. 7A and 7B illustrate respective wave forms of the phase signals $\phi_A$, $\phi_B$ outputted from the speed detector 129 according to the rotation of the induction motor 131 of the elevator system. Here, the phase signals $\phi_A$, $\phi_B$ respectively denote relative values with regard to a rotating direction of a shaft in the induction motor 131, wherein, the phase signal $\phi_A$ indicates a rightward rotation, and the phase signal $\phi_B$ indicates a leftward rotation.

The operation of the emergency control system according to the present invention will now be described.

First, in the case in which a supply voltage from the power source 1 is normally provided, the operation of the apparatus according to the present invention is identical to that of the conventional art.

However, when there occurs an emergency situation in the elevator system, such as a power failure, the elevator car operation is halted. Accordingly, the switching node 18 is connected and the switching node 2 is disconnected. At this time, the emergency power supply 19 converts the direct current voltage outputted from the battery 20 into a three-phase alternating current voltage, and the converted voltage is supplied to the converter 3 and the transformer 13, for thereby restoring the supply of power.

The control circuit 200 is operated by the voltage outputted from the transformer 13, and serves to control the inverter 130.

Figure 9:
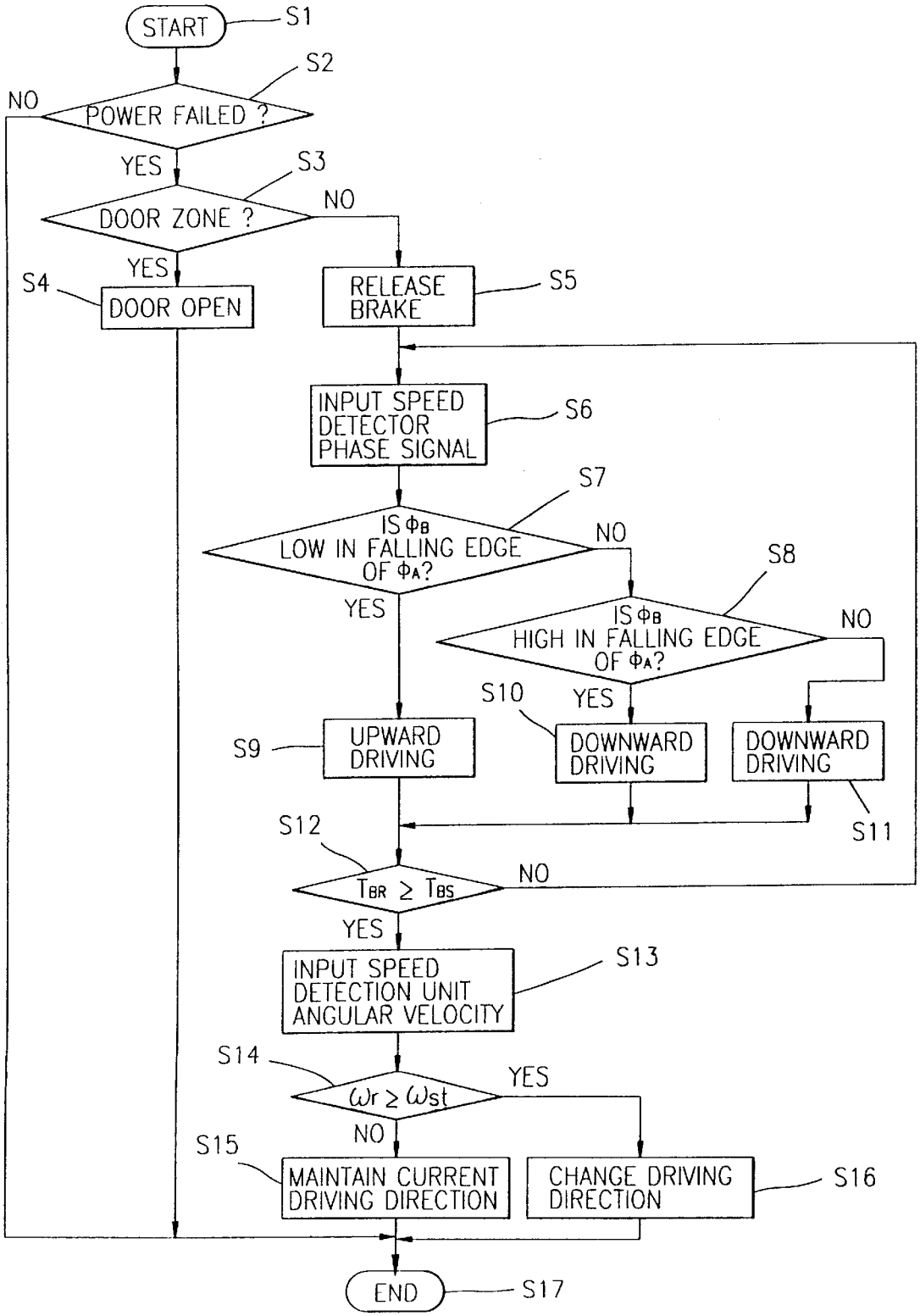
FIG. 9 is a flow chart illustrating an emergency control method of an elevator system according to the present invention.

Specifically, as shown in FIG. 9, when the power fails (Step S1), the control circuit 200 determines (Step S2) whether there has occurred a power failure. Then, it is determined whether the cage 15 (i.e., elevator) at the moment of the power failure is located within a door zone of the cage 15 accessible to and from the outside (Step S3), and if the cage 15 is within the door zone, the elevator car door is opened (Step S4); otherwise, the elevator brake is released to an extent so that the elevator car may move (Step S5) toward a desirable location by use of the weight difference between the cage 15 and the balance weight 17.

The driving direction setting unit 121 in the control circuit 200 receives (Step S6) the phase signals $\phi_A$, $\phi_B$ outputted from the speed detector 129 according to the rotation of the induction motor 131, and determines (Step S7) whether the phase signal $\phi_B$ in FIG. 7B is at a low level at a falling edge of the phase signal $\phi_A$ as in FIG. 7A, and if the phase signal $\phi_B$ is at a low level, a speed command $\omega_r$,* is outputted from the speed command generator 122 and serves to drive the elevator car to move upwardly (Step S9). Otherwise, the driving direction setting unit 121 determines (Step S8) whether the other phase signal $\phi_B$ (in FIG. 8B) is at a high level at a falling edge of the phase signal $\phi_A$ (in FIG. 8A), and if the phase signal $\phi_B$ in FIG. 8B is at a high level at a falling edge of the phase signal $\phi_A$ as in FIG. 8A, the elevator car is driven downwardly (Step S10); otherwise, the elevator car is driven downwardly (Step S11).

That is, when the speed command $\omega_r$* is applied to the speed controller 124 which outputs the current command I*, the current controller 126 which has received the current command I* applies the voltage command V* to the inverter 130 which serves to operate the induction motor 131 for thereby allowing the elevator car to move.

Next, after releasing the brake 11, an emergency running time $T_{BR}$ and a setting time $T_{BS}$ are compared to each other, and if the emergency running time $T_{BR}$ is equal to or greater than the setting time $T_{BS}$, the angular velocity $\omega_r$ is received (Step S13) from the speed detection unit 128; otherwise, the phase signals are received from the speed detector 129(Step S6).

Then, the applied angular velocity $\omega_r$ and the setting speed $w_{st}$ are compared to each other (Step 14) in the driving direction setting unit 121, and if the angular velocity $\omega_r$ is not equal to or greater than the setting speed $\omega_{st}$, the elevator car maintains the initial running direction (Step S15); otherwise, the running direction of the elevator car is changed (Step 16). At this time, the elevator car running is carried out until a difference between the angular velocity $\omega_r$ and the angular speed command $\omega_r$* becomes "0" or a difference between the current I and the current command I* becomes "0", for thereby completing the rescue driving operation (Step S17).

As described above, the apparatus and method for controlling an elevator system in an emergency operation according to the present invention shortens a rescue time by determining an elevator car driving direction by use of phase signals outputted from the speed detector during a driving interruption caused by a power failure.

What is claimed is:

1. An apparatus for controlling an emergency operation in an elevator system, comprising:

an inverter for inverting a direct voltage into alternating voltages and driving an induction motor with the alternating voltages;

a current detector for detecting current that flows through the induction motor;

a speed detector for detecting a speed of the induction motor and outputting phase signals; and a control circuit for receiving the current outputted from the current detector and the phase signals outputted from the speed detector, and outputting a voltage command to the inverter, the control circuit including, a speed detection unit for receiving the phase signals outputted from the speed detector, and calculating an angular velocity of the induction motor;

a driving direction setting unit for receiving the phase signals outputted from the speed detector and the angular velocity from the speed detection unit, and determining a driving direction of an elevator car;

a speed command generator for receiving an output signal from the driving direction setting unit, and outputting a speed command;

a first subtractor for outputting a difference value between the speed command and the angular velocity;

a speed controller for amplifying the difference value outputted from the first subtractor, and outputting a current command for the induction motor;

a second subtractor for outputting a difference value between the current command and the current outputted from the current detector; and a current controller for amplifying the difference value outputted from the second subtractor, and outputting the voltage command to the inverter.

2. A method for controlling an emergency operation in an elevator system, comprising the steps of:

first determining whether an elevator car is at a door zone of the elevator system for providing access to and from the elevator car;

second determining a driving direction of the elevator car in accordance with phase signals from a motor speed detector so that when the elevator car is at the door zone, the elevator door is opened, and otherwise, a brake of the elevator car is released;

third determining whether a count time is equal to or greater than a setting time, wherein the count time is counted from a time point at which the brake was released in said second determining step;

fourth determining whether an angular velocity of an induction motor for driving the elevator car is equal to or greater than a setting velocity, when the count time is greater than the setting time; and maintaining a current elevator car direction determined after releasing the brake, when the angular velocity is equal to or greater than the setting velocity, and otherwise, changing the driving direction of the elevator car.

3. The method of claim 2, wherein the second determining step further comprises the steps of:

determining whether a first phase signal outputted from the motor speed detector is at a low level at the time of a falling edge of a second phase signal outputted from the motor speed detector; and determining whether the first phase signal is at a high level at the time of the falling edge of the second phase signal.

4. The method of claim 3, wherein the step for determining whether the first phase signal is at a low level further comprises a step for driving the elevator car upwardly upon determining that the first phase signal is at a low level.

5. The method of claim 3, wherein the step for determining whether the first phase signal is at a high level further comprises a step for driving the elevator car downwardly upon determining that the first phase signal is at a high level.

6. The apparatus of claim 1, wherein the driving direction setting unit compares the phase signals to each other to determine whether a first phase signal of the phase signals is at a low level at the time of a falling edge of a second phase signal of the phase signals, and determines the driving direction of the elevator car based on this comparison result.

7. The apparatus of claim 1, wherein the driving direction setting unit compares the phase signals to each other to determine whether a first phase signal of the phase signals is at a high level at the time of a falling edge of a second phase signal of the phase signals, and determines the driving direction of the elevator car based on this comparison result.

8. An apparatus for controlling an emergency operation in an elevator system, the elevator system including a driving unit for driving an induction motor, the apparatus comprising:

a current detector for detecting current flowing through the induction motor;

a speed detector for detecting a speed of the induction motor and outputting phase signals based on this detection; and a control circuit for controlling the driving unit based on the current detected by the current detector and based on the phase signals outputted from the speed detector, the control circuit including, a driving direction setting unit for receiving the phase signals outputted from the speed detector, and determining a driving direction of an elevator car based on the phase signals.

a speed detection unit for receiving the phase signals outputted from the speed detector and calculating an angular velocity of the induction motor based on the phase signals, a speed command generator for receiving an output signal from the driving direction setting unit and outputting a speed command based on the received output signal from the driving direction setting unit, a first subtractor for outputting a difference between the speed command and the calculated angular velocity of the induction motor, a speed controller for amplifying the difference outputted from the first subtractor and outputting a current command for the induction motor based on the amplified difference, a second subtractor for outputting a difference between the current command and the current detected by the current detector, and a current controller for amplifying the difference outputted from the second subtractor, generating a voltage command based on this amplified difference, and outputting the voltage command to the driving unit to control the driving unit.

9. The apparatus of claim 8, wherein the phase signals include first and second phase signals and the driving direction setting unit compared the first and second phase signals to each other to determine the driving direction of the elevator car.

10. The apparatus of claim 9, wherein the driving direction setting unit determines whether the first phase signal is at a low level at the time of a falling edge of the second phase signal, and drives the elevator car upwardly based on this determination.

11. The apparatus of claim 9, wherein the driving direction setting unit determines whether the first phase signal is at a high level at the time of a falling edge of the second phase signal, and drives the elevator car downwardly based on this determination.

12. A method for controlling an emergency operation in an elevator system, the elevator system including a driving unit for driving an induction motor, the method comprising:

detecting current flowing through the induction motor;

detecting a speed of the induction motor and outputting phase signals based on this speed detection; and controlling the driving unit based on the current detected from said detecting step and based on the phase signals, said controlling step including, determining, in a driving direction setting unit, a driving direction of an elevator car based on the phase signals, calculating an angular velocity of the induction motor based on the phase signals, receiving an output signal from the driving direction setting unit and outputting a speed command based on the received output signal from the driving direction setting unit, calculating a first difference between the speed command and the calculated angular velocity of the induction motor, amplifying the first difference calculated from said calculating step and outputting a current command for the induction motor based on the amplified difference, calculating a second difference between the current command and the current detected from said detecting step, amplifying the second difference, generating a voltage command based on this amplified second difference, and outputting the voltage command to the driving unit to control the driving unit.

13. The method of claim 12, wherein in said speed detecting step, the phase signals include first and second phase signals and in said determining step, the driving direction setting unit compares the first and second phase signals to each other to determine the driving direction of the elevator car.

14. The method of claim 13, wherein in said determining step, the driving direction setting unit determines whether the first phase signal is at a low level at the time of a falling edge of the second phase signal, and drives the elevator car upwardly based on this determination.

15. The method of claim 13, wherein in said determining step, the driving direction setting unit determines whether the first phase signal is at a high level at the time of a falling edge of the second phase signal, and drives the elevator car downwardly based on this determination.

* * * * *